United States Patent [19]

Swift et al.

[11] 4,330,349

[45] May 18, 1982

[54] METHOD FOR PREPARING CONDUCTIVE FIBER BRUSHES

[75] Inventors: Joseph A. Swift, Ontario; C. Michael Ray, Fairport; Joan R. Ewing, Pittsford, all of N.Y.

[73] Assignee: Xerox Corporation, Stamford, Conn.

[21] Appl. No.: 193,241

[22] Filed: Oct. 2, 1980

[51] Int. Cl.[3] ..... A46D 1/00

[52] U.S. Cl. ..... 156/72; 29/826; 156/166; 156/167; 156/170; 156/174; 427/114; 300/21

[58] Field of Search ..... 156/72, 170, 173, 174, 156/169, 175, 166, 167; 361/225, 212, 221; 355/3 CH, 3 R; 29/826; 174/127; 15/160, 199, 200; 300/1, 2, 21, 4; 118/657, 658; 427/114, 113

[56] References Cited

U.S. PATENT DOCUMENTS

| | | | |
|---|---|---|---|
| 2,294,480 | 9/1942 | Rohweder et al. | 156/372 |
| 3,352,604 | 11/1967 | Melcher | 300/1 |
| 3,689,117 | 9/1972 | Hules | 300/21 |
| 3,691,993 | 9/1972 | Krause et al. | 118/637 |
| 3,877,417 | 4/1975 | Jeromin | 118/637 |
| 3,900,591 | 8/1975 | Kline | 427/24 |
| 3,993,021 | 11/1976 | Kline | 118/651 |
| 4,031,188 | 6/1977 | Kohler | 423/447.6 |

FOREIGN PATENT DOCUMENTS

| | | |
|---|---|---|
| 55-29837 | 3/1980 | Japan . |
| 55-29838 | 3/1980 | Japan . |

OTHER PUBLICATIONS

Pending U.S. Patent Application Serial No. 174,783, Filed 8/4/80, by Hugh Murray & Lawrence M. Marks, for "Charge Process with a Carbon Fiber Brush Electrode".

*Primary Examiner*—Norman Morgenstern
*Assistant Examiner*—Thurman K. Page

[57] ABSTRACT

A method for making conductive brushes which comprises providing a rotatable cylindrical mandrel having a plurality of longitudinal recesses on its surface, and winding electrically conductive fibers from a supply around the mandrel by rotating the mandrel. The brush backing or base may be formed by a number of methods utilizing the recesses on the surface of the mandrel. In one embodiment, the brush backing is formed by placing a strip of a conductive material in each of the recesses, and after the conductive fibers have been wound thereover, the conductive fiber windings are caused to adhere to each other by adhesive means and another strip of conductive material is placed over the windings to mate with the strip in the recess to form the backing for the conductive brush. Individual conductive brushes are obtained by cutting the conductive fibers in the longitudinal direction of the mandrel. Other embodiments of the method for producing the backing or base of the conductive brushes, including one embodiment in which a mandrel without recesses is used, are also disclosed.

15 Claims, 4 Drawing Figures

METHOD FOR PREPARING CONDUCTIVE FIBER BRUSHES

This invention relates to a novel and economical method for making conductive fiber brushes, and to the brushes produced thereby.

BACKGROUND OF THE INVENTION AND PRIOR ART STATEMENT

It is known in the art that electrically conductive brushes have a number of uses. For example, a U.S. Pat. No. 3,691,993, to Krause et al, metallized fiber brush roller, made of metal fibers or nonmetallic fibers which are provided with a conductive coating, is subjected to a D.C. bias voltage for use in the image transfer operation in an electrostatic copying machine. Similarly, in copending application of Hugh Murray and Lawrence M. Marks, for "Charge Process with a Carbon Fiber Brush Electrode", Ser. No. 174,783, filed Aug. 4, 1980, assigned to the assignee of the present application and the disclosure of which is hereby incorporated by reference, there is disclosed a contact charging method using a carbon fiber brush electrode. Other uses for conductive brushes are also known. Accordingly, there is a need for an improved, economical and efficient method for making conductive brushes, and a need for the conductive brushes so produced.

In Hules U.S. Pat. No. 3,689,117, there is disclosed a method for making a brush for neutralizing static electrical charges from electrically conductive carbonaceous filaments, which involves the winding of carbon filaments around two rods mounted on two rotating end plates. After the winding is completed, a potting compound is applied to the outside of the windings over the rods. A U-shaped shield is then placed over each of the rods and the carbon filaments between the two rods is cut in half to form two brushes. The present invention provides an improved method for producing the conductive brushes. For example, in the method of Hules, the carbon filaments are caused to make two U-turns for each revolution of the winding apparatus. Since the rods on which the filaments are wound are of small diameters, the carbon filaments tend to break and thus to interrupt the winding process. Again, the method of Hules is adopted for making two brushes at one time, and it would be desirable to make a larger number of brushes for each winding operation. Another difficulty with the Hules method resides in the fact that brushes made by that method tend to have the strands of filaments not entirely perpendicular with respect to the conductive shield, but tend to be slightly slanted.

As indicated above, in Krause et al U.S. Pat. No. 3,691,993, there is disclosed the use of a D.C. biased metallized fiber brush roller for image transfer in an electrostatic copying machine. The metallized fibers of Krause et al are metal fibers, such as stainless steel fibers, and synthetic fibers, such as dynel and rayon fibers coated with a conductive material.

In Jeromin U.S. Pat. No. 3,877,417, there is disclosed brushes mounted on transfer corotron housing in an electrostatic copying process, to apply even pressure on the transfer medium to urge it against the surface of the photoconductive member. The brushes of Jeromin may be made of conductive or nonconducting materials.

In Kline U.S. Pat. Nos. 3,900,591 and 3,993,021, there is disclosed an image transfer device, which has a top layer of an electrically conductive fuzz fabric. The preferred fabric is a metal impregnated natural or synthetic fiber pile fabric, such as a silver impregnated polyamide pile fabric.

In Kohler U.S. Pat. No. 4,031,188, there is disclosed a process for forming carbonaceous fibers from polyacrylonitrile fibers, in which the polycarylonitrile is treated with an amine, oxidized at an elevated temperature, and carbonized by heating it to a temperature at least 1000° C.

Finally, Japanese patent application Nos. 53-102630 and 53-102631, both in the name of Yoshisuke Takekida and assigned to Nippon Denki K.K. and filed Aug. 22, 1978, which were published under Nos. 55-29837(A) and 55-29838(A) on March 3, 1980, disclose a charging and transfer device for electrophotography which is made of a bundle of conductive thin fibrous wires shaped into a brush form by means of a holder in the shape of an open channel. Copies of the translated abstracts of these Japanese applications, in the form available to the present applicants, are attached to this application.

While the prior art methods for making conductive brushes, particularly the method of Hules, have been effective in making certain conductive brushes, there is a continuing need for improved and economical methods for making such conductive brushes.

Accordingly, it is an object of the present invention to provide an improved and efficient method for making conductive brushes.

It is another object of the present invention to provide an economical method for making conductive brushes of carbon fibers.

These and other objects of the invention can be gathered from the following detailed disclosure.

SUMMARY OF THE INVENTION

The above objects are accomplished in accordance with the present invention by a method for making conductive brushes which comprises providing a rotatable cylindrical mandrel having a plurality of longitudinal recesses on its surface, and winding electrically conductive fibers from a supply around the mandrel by rotating the mandrel. The brush backing or base may be formed by a number of methods utilizing the recesses on the surface of the mandrel. In one embodiment, the brush backing is formed by placing a strip of a conductive material in each of the recesses, and after the conductive fibers have been wound thereover, the conductive fiber windings are caused to adhere to each other by adhesive means and another strip of a conductive material is placed over the windings to mate with the strip in the recess to form the backing for the conductive brush. Individual conductive brushes are obtained by cutting the conductive fibers in the longitudinal direction of the mandrel. Other embodiments of the method for producing the backing or base of the conductive brushes are also disclosed.

DETAILED DESCRIPTION OF THE INVENTION

Figure 1:
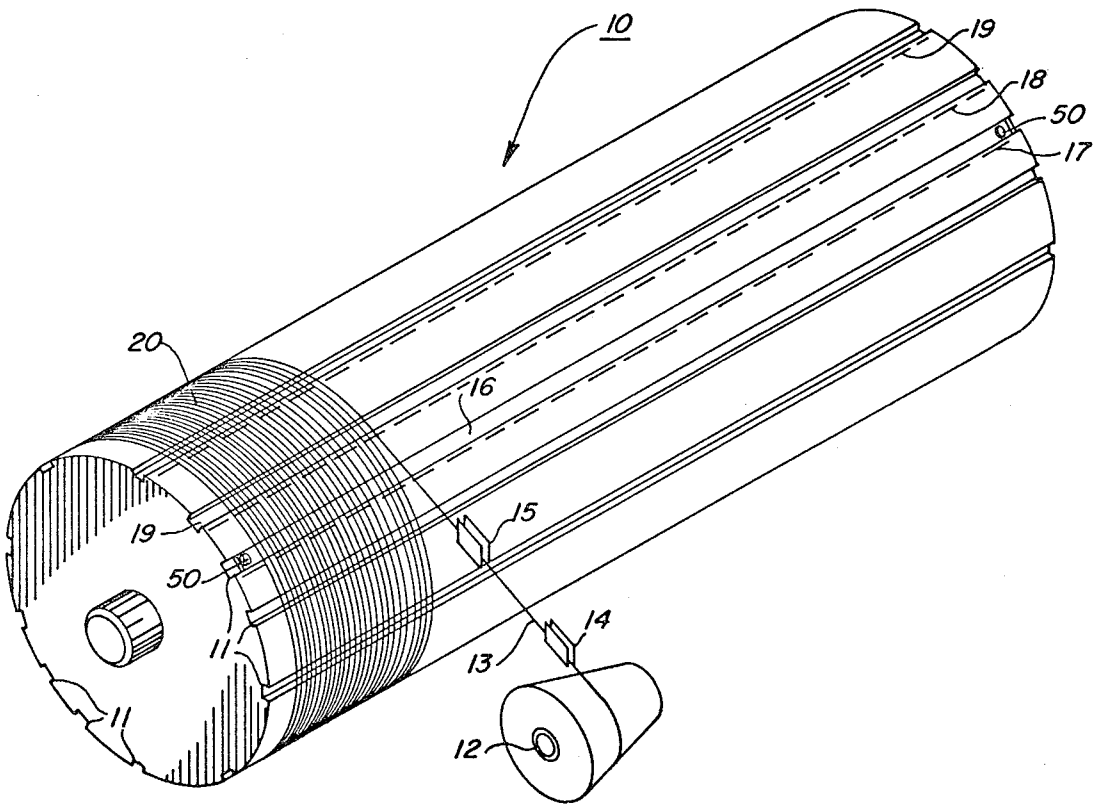
FIG. 1 shows a schematic view of a rotatable cylindrical mandrel having a plurality of longitudinal recesses on its surface, which is suitable for use in the method of the present invention for making conductive brushes.

A basic embodiment of the method of the present invention for making conductive brushes is schematically illustrated in FIG. 1. In FIG. 1, a rotatable and generally cylindrical mandrel 10 is shown to have a plurality of recesses or slots 11 thereon. The recesses 11 run longitudinally along the surface of the mandrel 10 and are generally parallel to the axis of the mandrel. The recesses 11 are shown to be generally rectangular in shape, but they may be of any suitable shape and size to accommodate the backing or base of the conductive brushes, to be described below. The number of recesses 11 provided around the circumference of the mandrel is not critical, although the larger the number of recesses, the more conductive brushes are produced per complete winding of the mandrel. It is particularly preferred that the number of recesses 11 around the mandrel be divisible by 2 or 3 so that a given mandrel can produce different conductive brushes with varying lengths of fibers or strands, as will be more fully explained below.

A supply of an electrically conductive fiber, such as carbon/graphite fiber, in the form of a bobbin 12 is provided. Carbon/graphite fiber is a conductive fiber material available commercially. For example, the Hercules, Inc. has graphite fibers under its tradename, Magnamite, and the Stackpole Fibers Company has available Panex (trademark) carbon/graphite fibers. The material is sometimes simply referred to as carbon fibers. For example, the Union Carbide Company makes available Thornel carbon fibers and the Celanese Corporation has Celion carbon fibers. For the sake of simplicity, these materials will be collectively referred to as carbon fibers herein. These carbon fibers are available in strands or tows of different sizes. For example, a strand is available which is about 1/16 inch in width and contains about 6000 filaments or fibers of several microns in diameter. Tows several inches wide, or wider, containing tens of thousands of filaments are also available. It is to be understood that when large tows or bundles of fibers are used, fewer turns or windings are needed to make the conductive brushes herein. In addition to conductive carbon fibers, other conductive fibers also may be used in the method of the present invention. For example, the metallized fibers disclosed in Krause U.S. Pat. No. 3,691,993 are suitable. In particular, a stainless steel fiber, from a few microns to about 12 microns in diameter, is very useful in the present method.

Referring again to FIG. 1, the conductive fiber 13 is fed through guide means 14 and 15 for winding on to the mandrel. After a strip of a backing material substantially fitting the size of the recesses 11 have been positioned in each of the recesses 11, the conductive fiber 13 may be wound on the mandrel by rotating the mandrel (by means not shown). During the winding process, the guide means 14 and 15 are mounted on moving means (not shown) for sliding movement along the axial direction of the mandrel. After the mandrel has been completely wound, the rotating motion is stopped. An adhesive, for example, a glue or a thermoplastic adhesive material, is applied onto the windings of the conductive fibers over the strip 16. Thereafter, a second strip of a conductive material, essentially similar to strip 16 is placed over the adhesive material and in an opposing position to the strip 16 in each of the recesses 11. After the carbon fiber windings and the strips are thus fastened together, the conductive fibers are then cut in the longitudinal direction of the mandrel to produce the conductive brushes herein. One such brush is produced by cutting along the dotted lines 17 and 18 shown in FIG. 1.

The strips 16 may be held in position in the recesses 11 by a variety of means. When the strips 16 are made of a conductive metal, for example, aluminum or stainless steel, they are generally 1/16 to ⅛ inch thick although other sizes also may be used. The recesses can be accurately made to accommodate the strips in a tight fit while presenting a smooth surface on the mandrel for the windings. Another method for holding the strips in place takes advantage of the fact that each end of the strips generally extends somewhat beyond the windings, and a screw 50 (illustrated in FIG. 1 on one of strips) or other clamping means can be used to hold the strip in position. When stainless steel or other ferromagnetic metal strips are used, magnet means built into each of the recesses 11 may be used to hold the strips in position.

Mandrel 10 can be used to make conductive brushes having fiber length substantially longer than the brush produced by cutting along dotted lines 17 and 18. Such a long fibered brush may be made, for example, by leaving the recess labelled 19 in FIG. 1 without a strip 16 and after the winding has completed, cut along dotted lines 17 and 19 to obtain the long fibered brush.

It will be appreciated that guide means 14 and 15 can be accurately positioned with respect to the mandrel during the winding process so that the windings 20 on the mandrel can be made in a plane substantially perpendicular to the axis of the mandrel. In addition, the mandrel 10 can be made to slide during the winding process and the guide means 14 and 15 remain stationary. However, it is preferred that the rotating mandrel 10 be made stationary in its longitudinal direction during the winding process and the guide means 14 and 15 be moved longitudinally with respect to the mandrel 10.

Figure 2:
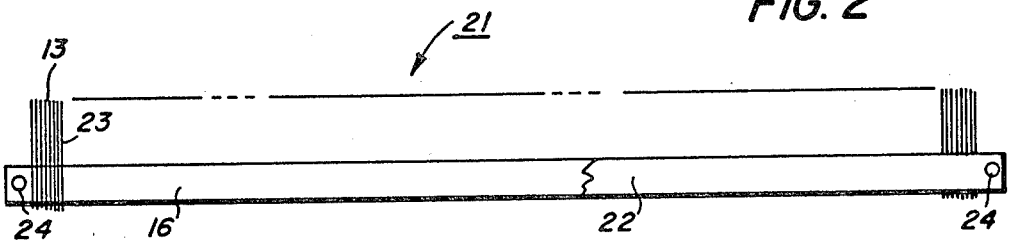
FIG. 2 is an illustrative view of a conductive brush made on the mandrel of FIG. 1.

FIG. 2 shows a conductive brush made by the apparatus shown in FIG. 1. The conductive brush 21 is shown to be made of a backing or base formed by the strip of a conductive material 16 and a second strip of a conductive material 22 thereover. The conductive fibers 13, in essentially equal length filaments 23, are held between the two strips 16 and 22. The two strips 16 and 22 may be further fastened together by mechanical fastening means, such as rivits or screws through eyelets 24. Although the conductive brush 21 has been described as made with conductive strips 16 and 22, which may be made of aluminum or stainless steel for example, this is not critical. If strips 16 and 22 are made of nonconducting material, electrical connection to the fibers or filaments may be made by other means, for example, through clamps mounted in the device in which the conductive brushes are to be used.

The size of the conductive brush 21 can be widely varied, depending on the particular useage for which it is intended. For many applications, such as the charging or transfer device in an electrostatographic copying machine, the size is relatively small. For example, a brush 12 inches long with an overall height of 1 inch to 1½ half inches may be very suitable. For such a brush, we prefer to employ strips (16 or 22) about ½ inch wide.

This would leave about 0.5 to 1 inch of filaments beyond the backing or base of the brush. Referring again to FIG. 1, it can be seen that with a mandrel of, say, about 6 inches in diameter, the circumference of the mandrel is then between 18 and 19 inches. This can be conveniently divided into 12 segments, i.e., with 12 recesses or slots 11 substantially evenly distributed around the circumference of the mandrel. Although the number of recesses or slots on the mandrel is not critical, it is preferred that the total number be one that is divisible by 2 or 3 so that when a brush having substantially longer filaments are required, the mandrel need not be changed to make such longer filament brushes. For example, the mandrel 10 in FIG. 1 is shown to have 12 recesses around its circumference. When long filament brushes are required, they can be produced on this mandrel by using only every other recess to produce 6 brushes. This illustrates one aspect of the versatility and economy associated with the present invention.

As indicated above, the windings 20 are fastened to each other by the application of an adhesive means along the surface areas of the recesses 11. This holds the filaments in place and prevents their sliding relative to each other. The adhesive means may also assist in fastening the conductive fibers or filaments to the strips forming the backing or base of the brushes. It is preferred that the adhesive material used be electrically conductive, although this is not critical. Various adhesive materials suitable for this purpose are known to the art, and they include conductive or nonconductive glues, double sided adhesive tapes, certain thermoplastic resins, etc. Examples of conductive glues suitable for the purpose are available from the Archeson Colloids Company under its trademark Electrodag adhesives. An example of a thermosetting and conductive resin useful for this purpose is an epoxy glue available from the Chomerics, Inc. under its tradename Cho-bond. Another example of a suitable adhesive material is a double sided adhesive foam tape available from the Adhesives Research, Inc. under its tradename ARclad. When such an adhesive foam tape is used, one piece may be placed on the strip 16 of FIG. 1 before the winding of the conductive fibers, and another piece placed on the windings just before the strip 22 is positioned thereover. In this manner, the individual filaments are fastened to each other as well as to the two strips 16 and 22.

Figure 3:
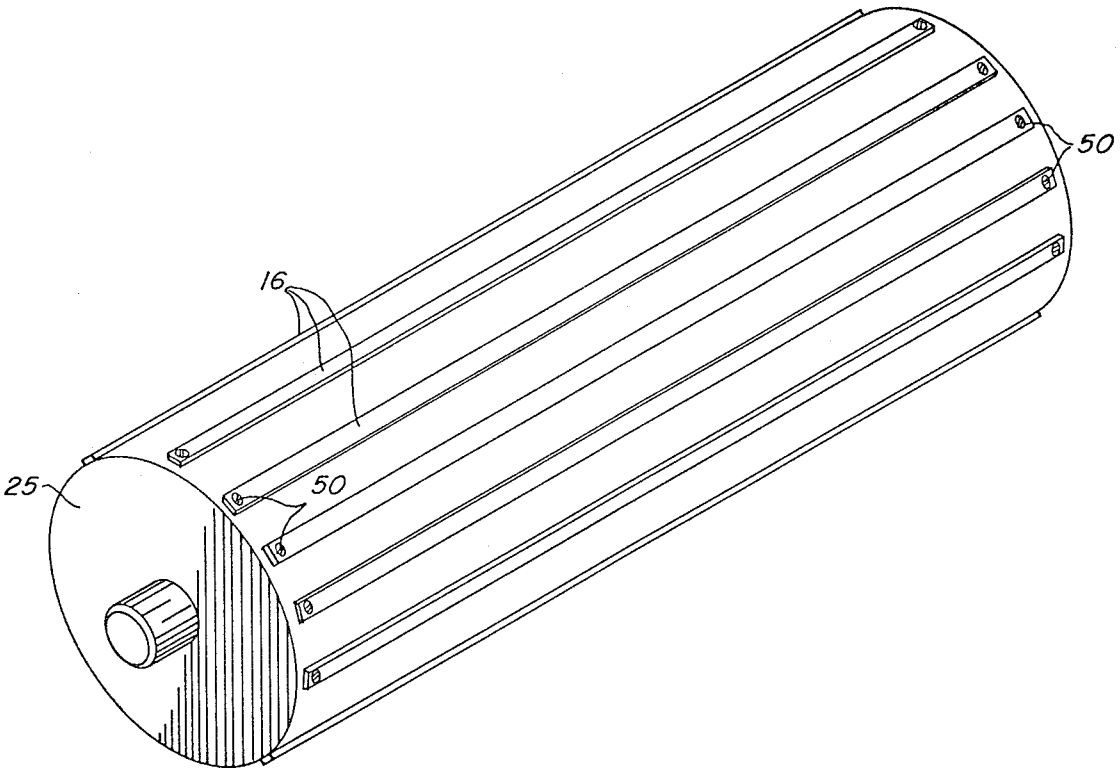
FIG. 3 is a partial schematic view of another embodiment of the method of the present invention for making conductive brushes, using a mandrel without recesses thereon.

Although the preferred embodiment of the method of the present invention, as described above, employs a mandrel having a plurality of recesses on its surface for accommodating the strips 16 which form a part of the backing or base for the conductive brushes, it will be appreciated that a mandrel without any recesses also may be used. This is particularly true when a thin strip 16 is employed, for example a strip 1/16 inch thick or thinner. Such a plain mandrel (25) is illustrated in FIG. 3, with a number of strips 16 fastened to its surface by screw means 50. Due to the relatively large diameter of the mandrel, and the thinness of the strips, windings of conductive fibers can be accurately placed on the device without undue difficulty. When such a mandrel is used, we prefer to employ a double sided adhesive foam tape on the strips 16 before the start of the winding operation. The foam tape is helpful in preventing slippage and breakage of the windings.

Figure 4:
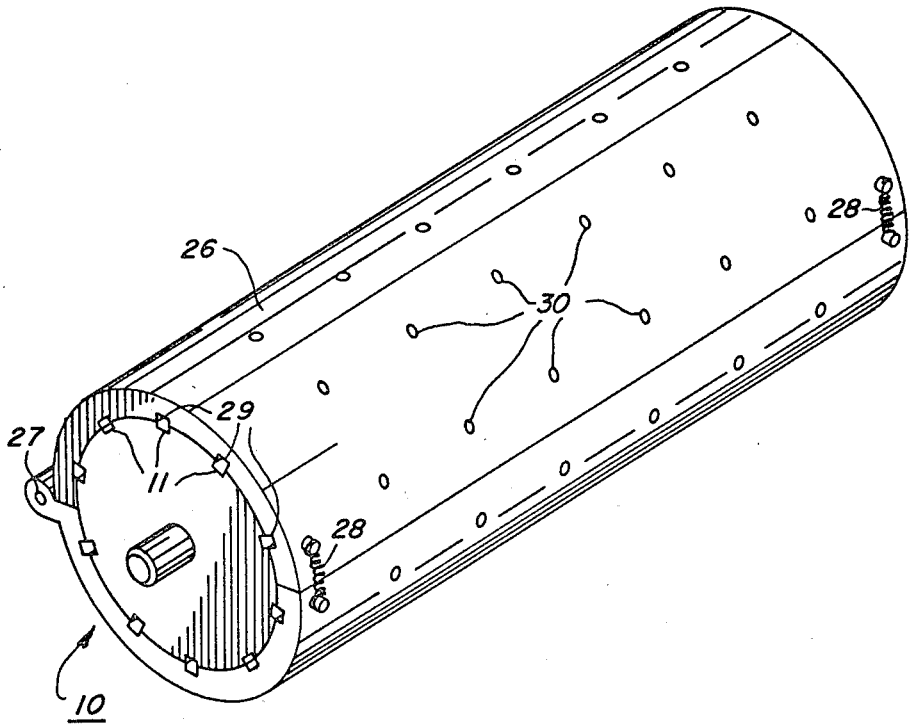
FIG. 4 is a partial schematic view of still another embodiment of the present invention.

Referring now to FIG. 4, an apparatus is illustrated which is suitable for use in another embodiment of the method of the present invention. The mandrel 10 in FIG. 4 is essentially the same as that shown in FIG. 1. In this embodiment, the strips 16 and 22 are not used, and the conductive fibers 13 wound onto the mandrel. After the carbon fibers have been wound, a coverlike device 26 for the mandrel is positioned over the mandrel and it substantially completely covers the mandrel and the windings. The cover 26 may be in the form of a cylindrical shell made of two halves which are hinged together by hinge 27. The two halves of cover 26 are made to fit over the mandrel 10 and the windings thereon snuggly. The two halves of the cover 26 may be urged into the closing position shown in FIG. 3 by spring means 28. Recesses 29 are provided on the inside surface of cover 26, corresponding to the recesses 11 on the mandrel. Conduit means 30 are provided in the cover 26 for communication with the recesses 29, so that a plastic or resinous material may be introduced into the recesses 11 and 29 after the cover has been closed over the mandrel. The introduction of a resinous material, for example, an injection moldable thermoplastic material, into the recesses 11 and 29 permits the formation of the backing or base for the conductive brushes without the use of strips 16 and 22 and the adhesive material on the windings. Conductive injection moldable thermoplastic materials are known to the art. In this embodiment of the method of the present invention, the steps are essentially the winding of the mandrel, the positioning of the cover over the mandrel, the introduction of the plastic or resinous material into the recesses, and after the plastic or resinous material has hardened, removal of the cover and the cutting of the conductive fiber windings to obtain the conductive brushes.

While the invention has been described in detail with reference to specific preferred embodiments, it will be appreciated that various modifications may be made from the specific details without departing from the spirit and scope of the invention.

What is claimed is:

1. A method for making conductive brushes which comprises providing a rotatable cylindrical mandrel having at least one longitudinal recess on its surface, positioning a first strip of a backing material in said recess, winding electrically conductive fibers from a supply around said mandrel by rotating the mandrel, fastening said conductive fiber windings to each other by adhesive means on the windings at the recess, positioning a second strip of a backing material on said conductive fiber windings opposite said recess, fastening said two strips together, and cutting the conductive fiber windings in the longitudinal direction of the mandrel to obtain conductive brushes of appropriate fiber length.

2. A method according to claim 1 wherein there are a plurality of recesses on the surface of said mandrel, and a first strip of a backing material is positioned in each recess so that the number of conductive brushes which can be produced equals the number of recesses.

3. A method according to claim 2 wherein said recesses are substantially equally spaced apart around the circumference of the mandrel.

4. A method according to claim 2 wherein said two strips of a backing material are conductive metallic strips.

5. A method according to claim 2 wherein each of said first strip of a backing material is fastened in one of said recesses during the winding operation by mechanical fastening means.

6. A method according to claim 2 wherein said adhesive means is applied to the surface of said first strip prior to the windings operation, and said adhesive means is again applied to the windings facing said first strip prior to the positioning of said second strip thereto.

7. A method according to claim 1 further comprising repeating the winding and fastening operations one or more times until the desired fiber density has been obtained, prior to positioning the second strip onto said conductive fiber windings.

8. A method according to claim 3 wherein the brush fibers are lengthened by leaving some of the recesses without the first strip to produce a reduced number of conductive brushes having lengthened brush fibers.

9. A method according to claim 2 wherein said conductive fibers are conductive carbon fibers.

10. A method for making conductive brushes which comprises providing a rotatable cylindrical mandrel having at least one longitudinal recess on its surface, winding electrically conductive fibers from a supply around said mandrel by rotating the mandrel, position a cover for said mandrel having recesses corresponding to the recesses on the mandrel over the conductive fiber windings with the recesses on the mandrel and the recesses on the cover in a facing relationship, applying a plastic material into said recesses to fasten said conductive fiber windings to each other and to provide a backing for said conductive brushes, and cutting the conductive fiber windings in the longitudinal direction of the mandrel to obtain conductive brushes of appropriate fiber length.

11. A method according to claim 10 wherein said conductive fibers are conductive carbon fibers.

12. A method according to claim 10 wherein said plastic material is applied through conduit means in said mandrel or in said cover.

13. A method according to claim 10 wherein said plastic material is a conductive thermoplastic resinous material.

14. A method for making conductive brushes which comprises providing a rotatable cylindrical mandrel having a substantially smooth drumlike surface, positioning a plurality of a first strip of backing material longitudinally on said mandrel, fastening said first strips to the mandrel, winding electrically conductive fibers from a supply around said mandrel by rotating the mandrel, fastening said conductive fiber windings to each other by adhesive means applied onto the windings over each of said first strips, positioning a second strip of a backing material on said conductive fiber windings opposite each said first strip, fastening said two strips together, cutting the conductive fiber windings in the longitudinal direction of the mandrel, and releasing said first strips from the mandrel to obtain the conductive brushes.

15. A method according to claim 14 wherein said windings are fastened to each other and are fastened to said first strips by placing a double-sided adhesive tape on each of said first strips prior to the winding operation.

* * * * *